US006098960A

United States Patent [19]

Lefavour et al.

[11] Patent Number: 6,098,960

[45] Date of Patent: Aug. 8, 2000

[54] HYDRAULIC SPIKE PULLER

[75] Inventors: John David Lefavour, Litchfield; Raymond G. Lavoie, Pembroke, both of N.H.

[73] Assignee: Framatome Connectors USA, Inc., Etters, Pa.

[21] Appl. No.: 09/283,270

[22] Filed: Mar. 31, 1999

[51] Int. Cl.[7] ..... B25C 11/00

[52] U.S. Cl. ..... 254/18

[58] Field of Search ..... 254/18, 21, 25, 254/20

[56] References Cited

U.S. PATENT DOCUMENTS

| | | | |
|---|---|---|---|
| 5,477,598 | 12/1995 | Borner, Jr. | 254/18 |
| 5,704,591 | 1/1998 | Byrne | 254/18 |
| 5,807,694 | 7/1999 | Butorac | 254/18 |
| 5,924,679 | 7/1999 | Wilson | 254/18 |

OTHER PUBLICATIONS

Advertisement—SP45 Spike Puller, Stanley, Nov. 1992, 1 page.

*Primary Examiner*—David A. Scherbel
*Assistant Examiner*—Lee Wilson
*Attorney, Agent, or Firm*—Perman & Green, LLP

[57] ABSTRACT

A hydraulic spike puller having a frame, a hydraulic drive section connected to the frame, and a spike contacting section connected to the hydraulic drive section. The spike puller has a handle repositionably connected to the frame. The handle is positionable in a straddle position or a parallel position relative to a railroad rail to pull a spike.

19 Claims, 6 Drawing Sheets

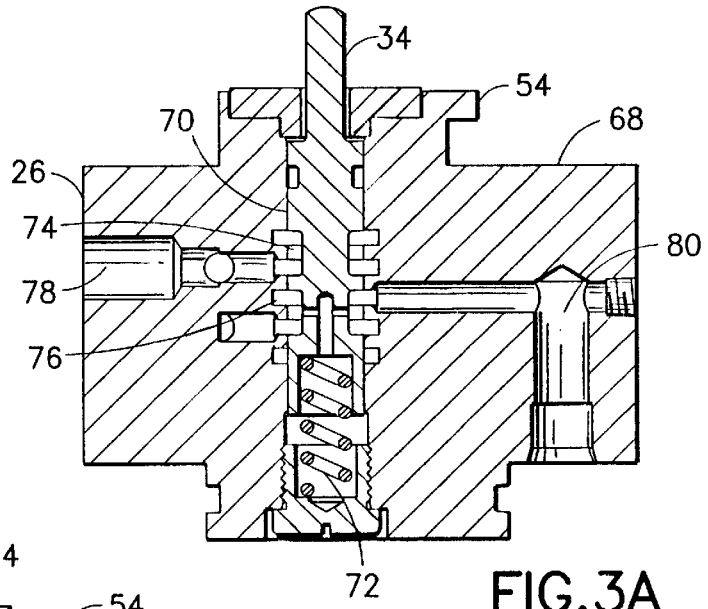
FIG.3A
FIG.3B
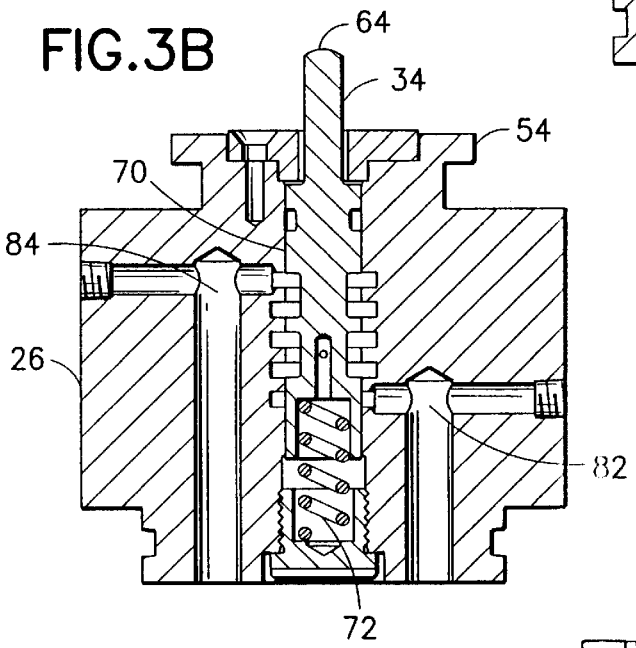
FIG.3C
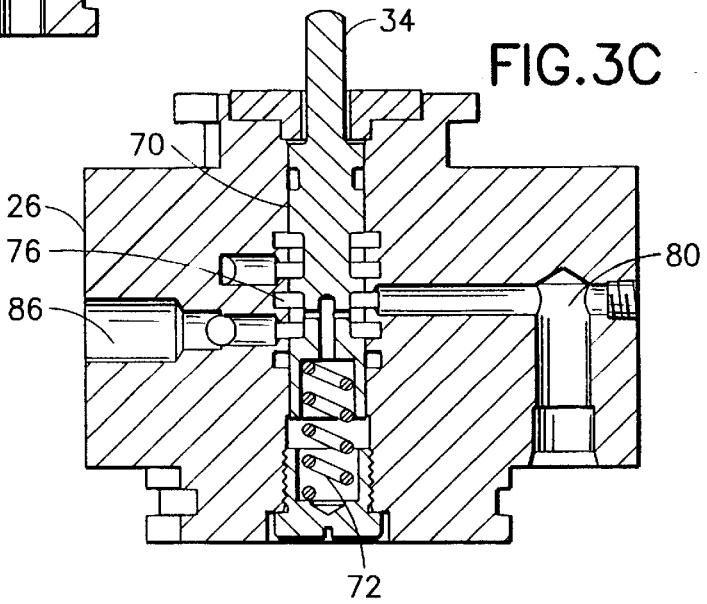

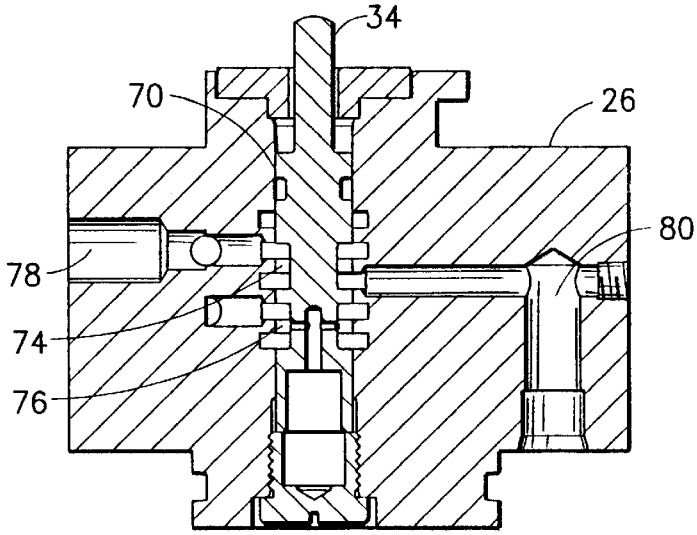
FIG.4A
FIG.4B
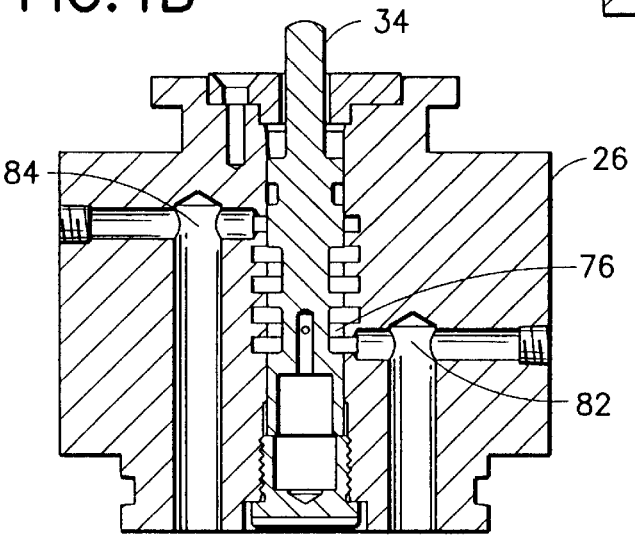
FIG.4C
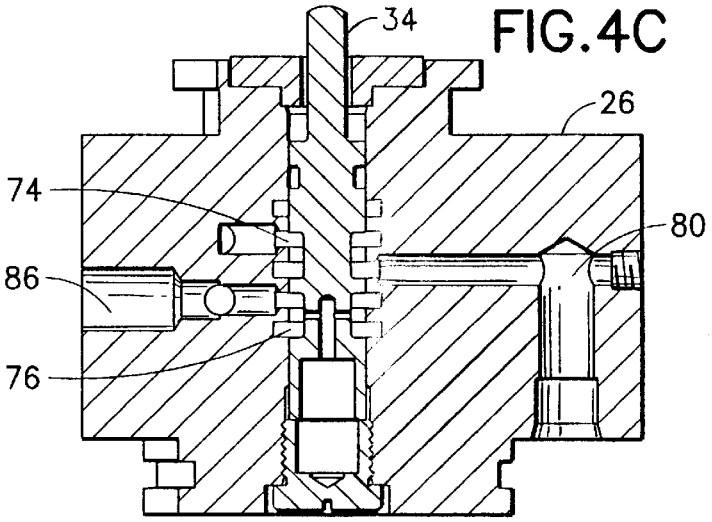

52
$50_L$
18
90
$50_R$ $50_L$
50
90
18
56
58
52
27
48
26
$50_R$
60
28
10
24
24
30
38
20
22
A
A

HYDRAULIC SPIKE PULLER

BACKGROUND OF THE INVENTION

1. Field of the Invention

The present invention relates to a tool and, more particularly, to a tool having a repositionable handle.

2. Prior Art

Stanley sells a hydraulic spike puller under the designation SP45. Two models are available. The model SP45101 has its handle orientated for use in a straddle position relative to the railroad rail where the user straddles the rail. The model SP45100 has its handle orientated for use in a parallel position relative to the railroad rail where the user stands parallel to the rail. Racine, a division of Framatome Connectors USA, Inc. sells a hydraulic spike puller under the catalog No. HSP-1. A problem with the prior art tools is that a single tool could not easily switch between straddle and parallel use positions.

SUMMARY OF THE INVENTION

In accordance with one embodiment of the present invention a hydraulic spike puller is provided having a frame, a hydraulic drive section connected to the frame, and a spike contacting section connected to the hydraulic drive section. The improvement comprises a handle repositionably connected to the frame. The handle is positionable in a straddle position or a parallel position relative to a railroad rail to pull a spike.

In accordance with another embodiment of the present invention a hydraulic tool manifold and rotatable handle assembly is provided comprising a manifold member, a valve member, a cap, a handle, and a user actuated control. The manifold member has hydraulic conduits therethrough. The valve member is movably mounted in one of the conduits of the manifold member. The cap is repositionably connected to the manifold member. The handle is connected to the cap. The user actuated control is movably connected to the handle and adapted to move the valve member relative to the manifold member. The handle and the user actuated control can be repositioned with the cap relative to the manifold member to allow the user actuated control to move the valve member at multiple positions of the handle relative to the manifold member.

In accordance with another embodiment of the present invention, a hydraulic spike puller is provided comprising a frame, a hydraulic drive section connected to the frame, and a spike contacting section connected to the hydraulic drive section. The improvement comprises a user control assembly comprising a handle section and a lever. The assembly is repositionably mounted to the hydraulic drive section.

BRIEF DESCRIPTION OF THE DRAWINGS

The foregoing aspects and other features of the present invention are explained in the following description, taken in connection with the accompanying drawings, wherein:

FIG. 3A is a cross-sectional view taken along line 3A—3A of FIG. 2;

FIG. 3B is a cross-sectional view taken along line 3B—3B of FIG. 2;

FIG. 3C is a cross-sectional view taken along line 3C—3C of FIG. 2;

FIG. 4A is a cross-sectional view as in FIG. 3A with the valve member depressed;

FIG. 4B is a cross-sectional view as in FIG. 3B with the valve member depressed;

FIG. 4C is a cross-sectional view as in FIG. 3C with the valve member depressed;

DETAILED DESCRIPTION OF THE PREFERRED EMBODIMENT

Figure 1B:
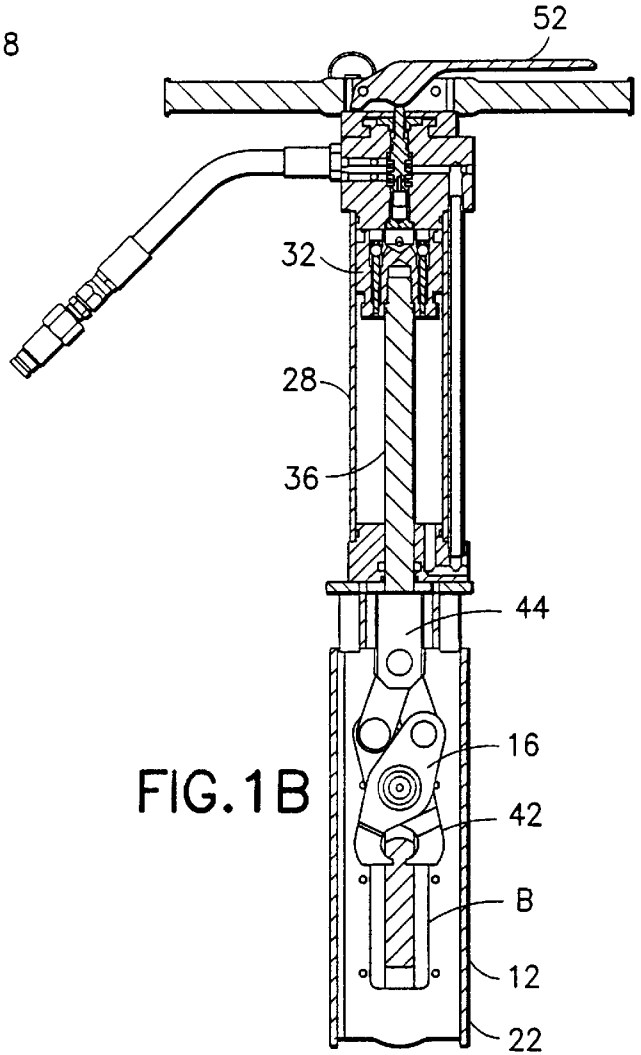
FIG. 1B is a cross-sectional view as in FIG. 1A with the spike contacting section at an up position.
Figure 1A:
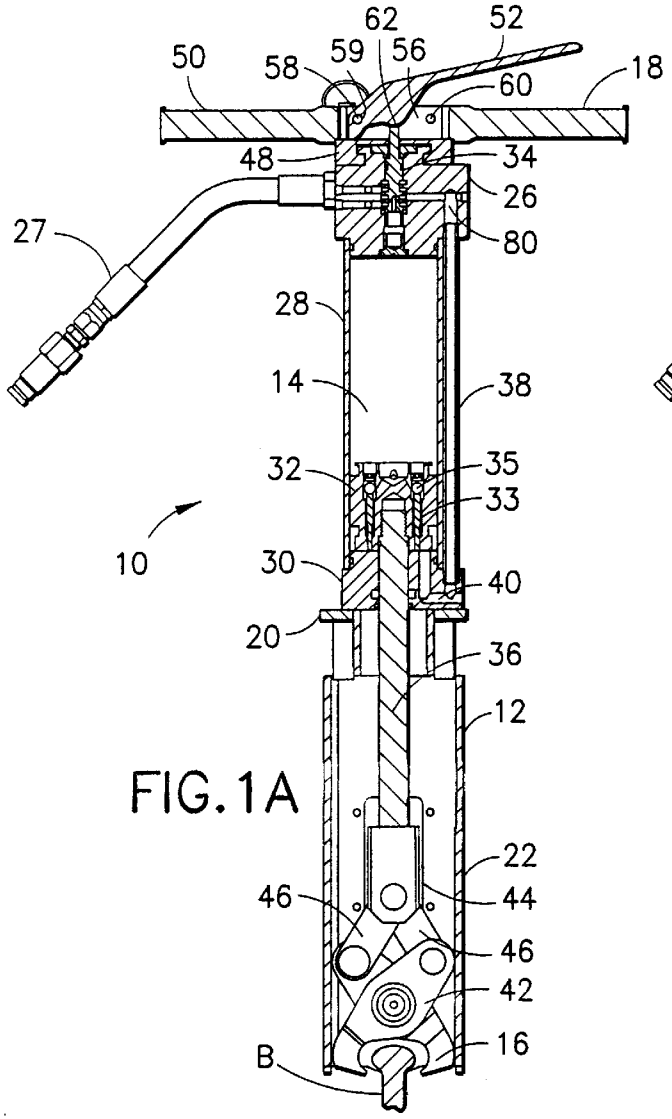
FIG. 1A is a schematic cross-sectional view of a hydraulic spike puller incorporating features of the present invention with the spike contacting section at a down position.
Figure 2:
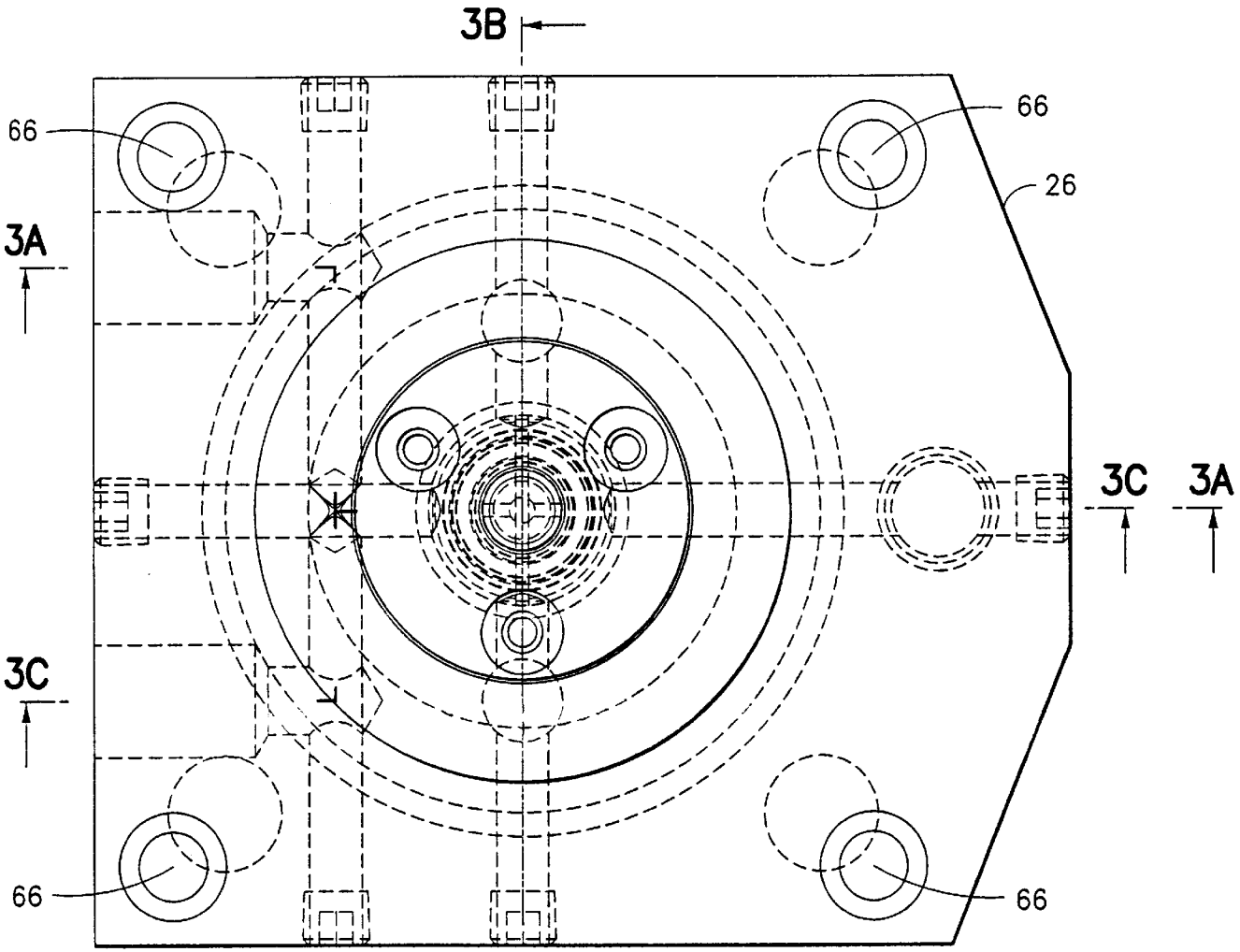
FIG. 2 is a top plan view of the manifold member used in the tool shown in FIG. 1A.

Referring to FIG. 1A, there is shown a schematic cross-sectional view of a tool 10 incorporating features of the present invention. Although the present invention will be described with reference to the single embodiment shown in the drawings, it should be understood that the present invention can be embodied in many alternate forms of embodiments. In addition, any suitable size, shape or type of elements or materials could be used.

Figures 5A, 5B:
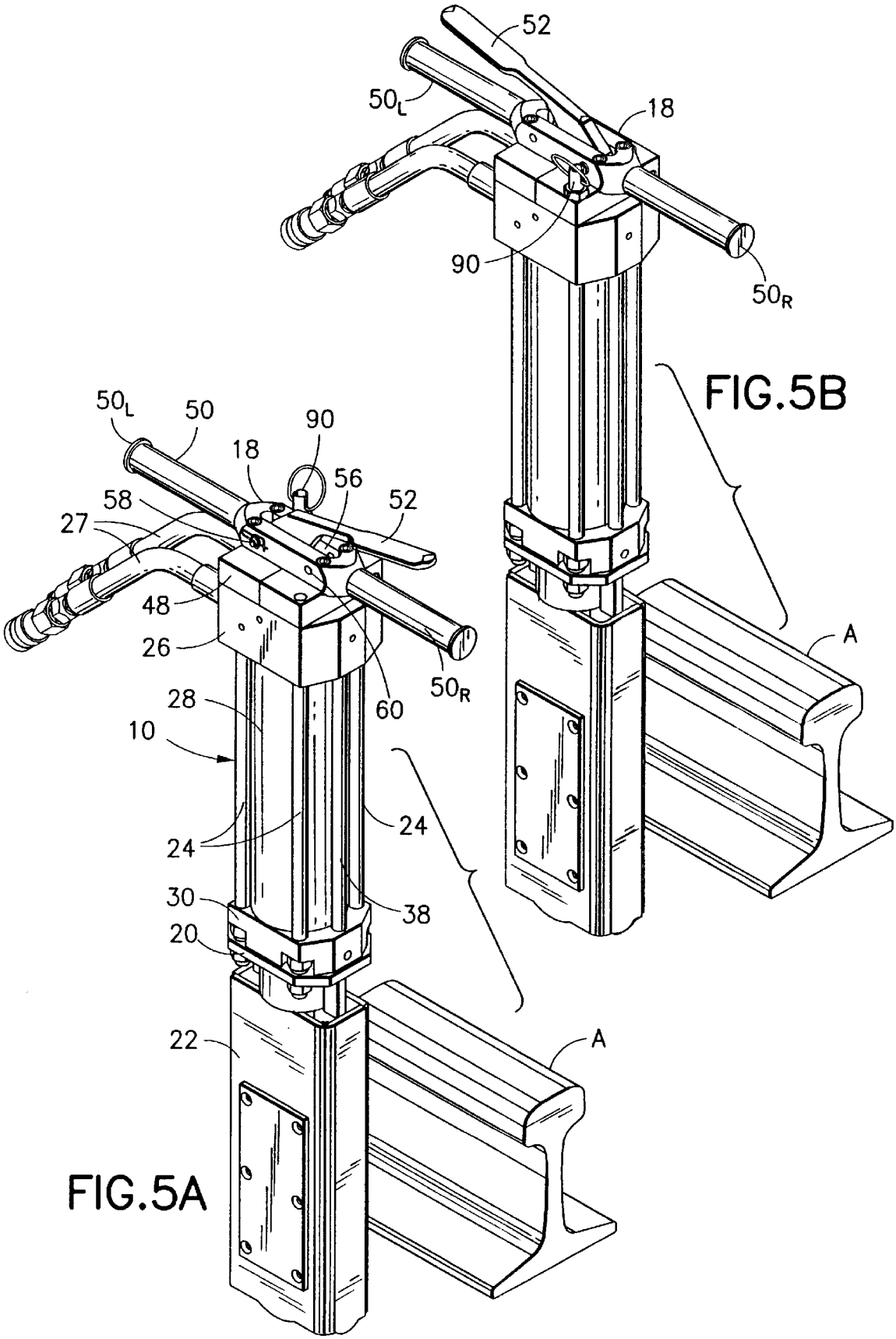
FIG. 5A is a perspective view of the tool shown in FIG. 1A next to a railroad rail with its handle in a parallel position relative to the rail.
FIG. 5B is a perspective view as in FIG. 5A with the control lever orientated in a reverse position.

In this embodiment the tool 10 is a hydraulic spike puller for pulling railroad spikes, such as when a railroad tie or rail is being replaced. However, in alternate embodiments features of the present invention could be used in alternative types of tools, such as pneumatic tools, jack hammers, a ballast tamper or any other tool with a two-hand handle and control lever assembly. The tool 10 generally comprises a frame 12, a hydraulic drive section 14, a spike contacting section 16, and an assembly 18. Referring also to FIG. 5A, a perspective view of the tool 10 is shown next to a railroad rail A. FIG. 1A shows a portion of a spike B intended to be pulled from a railroad tie (not shown) by the tool 10.

As seen best in FIGS. 1A and 5A, the frame 12 generally comprises a middle section 20, a cover 22, and structural bars 24. The hydraulic drive section 14 is mounted to the frame 12 by the middle section 20 and the structural bars 24. The hydraulic drive section 14 generally comprises a manifold member 26, a main tube 28, a bottom member 30, a piston member 32, a valve member 34, a connecting bar 36, and a supply tube 38. Two hoses 27 (a hydraulic fluid supply hose and a hydraulic fluid return hose) are connected between the manifold member 26 and a hydraulic pump (not shown) for supplying hydraulic fluid to drive the tool 10.

As seen best in FIG. 1A, the main tube 28 is connected between the manifold member 26 and the bottom member 30. The piston member 32 is movably mounted in a hydraulic fluid relieving area in the main tube 28 between a down position shown in FIG. 1A and an up position shown in FIG. 1B. The manifold member 26 has conduits therethrough. The supply tube 38 is connected between a conduit 80 in the manifold member 26 and a conduit 40 in the bottom member 30 which opens into the hydraulic fluid receiving area of the main tube 28. The connecting member 36 movably extends through the bottom member 30 and connects the piston member 32 to the spike contacting section 16. In alternate embodiments other types of drive sections or hydraulic conduiting could be provided.

The spike contacting section 16 generally comprises two tongs 42 pivotably connected to each other. The lower ends of the tongs 42 are designed to contact the spike B. The upper ends of the tongs 42 are pivotably connected to the pull member 44 by connecting links 46. The pull member 44 is connected to the connecting member 36. As seen in comparing FIG. 1A to FIG. 1B, when the pull member 44 is pulled upward, the tongs 42 move towards a grasping position to grasp onto the spike. In alternate embodiments other types of spike contacting sections could be provided.

The assembly 18 is a combined handle and control actuator assembly. However, in an alternate embodiment the user actuated control might be separate from the handle. The assembly 18 generally comprises a cap 48, a handle 50, and a user actuated control lever 52. The cap 48 is rotatably mounted on a post 54 (see FIG. 3B) of the manifold member 26. The handle 50 is fixedly attached to the cap 48. In this embodiment the handle 50 is a two-hand "T" type of handle, but other handle shapes could be used. The lever 52 is pivotably mounted to the handle 50 in a center groove 56 by a pin 58 at holes 59 in the handle. The handle has another set of holes 60, and the pin 58 is removable, such that the lever 52 can reverse 180° relative to the handle to accommodate left hand or right hand users. The lever 52 has a valve contact area 62 for contacting the top end 64 (see FIG. 3B) of the valve member 34.

Referring now to FIGS. 2 and 3A–3C, the manifold member 26 comprises four position holes 66 extending into its top side 68. The valve member 34 is mounted in the center conduit 70. A spring 72 biases the valve member 34 in the up position shown. The valve member 34 has two annular grooves 74, 76. The manifold member 26 has a first conduit 78, a second conduit 80, a third conduit 82, a fourth conduit 84, and a fifth conduit 86. In alternate embodiments other conduit configurations could be provided. The first conduit 78 connects one of the hoses 27 to the center conduit 70. The second conduit 80 connects the center conduit 70 to the supply tube 38. The third and fourth conduits 82, 84 connect the center conduit 70 to the top end of the hydraulic fluid receiving area of the main tube 28. The fifth conduit 86 connects the center conduit 70 to the other hose 27.

With the valve member 34 in the up position shown in FIGS. 3A–3C and the pump (not shown) ON, hydraulic fluid is pumped into conduit 78, through groove 74, into conduit 84, and into the main tube 28 to drive the piston 32 down to the position shown in FIG. 1A. Excess fluid located at the bottom side of the piston 32 in the main tube 28 is pushed into the conduit 40 (see FIG. 1A), through tube 38, into conduit 80, through groove 76, and out through the conduit 86. When the piston 32 is at the down position shown in FIG. 1A, rod bumpers 33 push the check balls 35 off their sealing seats on the piston 32 and allow additional fluid entering the main tube 28 to pass through the piston 32 into conduit 40, through tube 38, into conduit 80, through groove 76 and out conduit 86. The tool is "open center" with the piston located at this position. Referring now to FIGS. 4A–4C, the valve member 34 is shown moved down in the center conduit 70. The valve member 34 is moved down by the user depressing the lever 52 as shown in FIG. 1B. Hydraulic fluid is pumped into conduit 78, through groove 74, into conduit 80, through supply tube 38 (see FIG. 1B), through conduit 40, and into the main tube 28 on the underside of the piston 32. This causes the piston 32 to move upward in the main tube 28, pulling the connecting member 36 and spike contacting section 16, upward. Fluid on the top side of the piston 32 in the main tube 28 is transported out of the tool through conduit 82, groove 76, and conduit 86. The tool is "closed center" when the piston 32 is moving upward. Check balls 35 are forced into seats in the piston 32 to seal the through holes in the piston at the seats and allow the tool to reach full operating pressure with high pull force to remove the spike B. If the user releases the lever 52 the spring 72 biases the spool 34 to return to a position as shown in FIG. 1A and FIG. 3A. Fluid once again enters cylinder 28 through conduit 78, groove 74, conduit 84, and into main tube 28. Fluid flow and pressure push the balls 35 onto their seats to provide a seal. The balls 35 will remain seated until the bumper rods 33 strike member 30.

Referring now to FIGS. 1A and 5A, the cover 22 and spike contacting section 16 are designed to be placed and orientated relative to the rail A and spike B as shown. The tool 10 can be rotated 90° along its longitudinal axis relative to the rail A and still be able to properly pull out the spike B, however, such an orientation is not preferred. The preferred orientation is shown in FIGS. 5A–5D. FIG. 5A shows the handle 50 orientated in a parallel position relative to the rail A. In this position the user would stand facing the rail A with both feet on one side of the rail A. In FIG. 5A the control lever 52 is shown in a position over the right hand section $\mathbf{50}_R$ of the handle 50. The lever 52 is positioned for a right hand user to depress the lever with his right hand while grasping the right hand section $\mathbf{50}_R$. The hoses 27 are shown extending from the left hand side of the tool 10.

Referring now also to FIG. 5B, the same tool is shown in the same parallel position relative to the rail A. However, the assembly 18 has been moved to accommodate a left handed user. The lever 52 is located over the left hand section $\mathbf{50}_L$. In order to reposition the assembly 18 the cap 48 is rotatable on the manifold member 26. The assembly 18 has a spring loaded locking pin 90. The locking pin 90 has a bottom end which can project into one of the holes 66 (see FIG. 2) in the top side of the manifold member 26. Thus, the user can lift up the pin 90 from one of the holes 66, rotate the cap 48 on the post 54 (see FIG. 3B) of the manifold member to a new position, and release the pin 90 to extend back into one of the holes 66 and thereby lock the rotational position of the cap 48 relative to the manifold member 26 again. In alternate embodiments other types of means to repositionably mount the assembly 18 to the manifold member or frame could be provided. The manifold member 26 has four of the holes 66 which are 90° apart. However, in alternate embodiments more or less holes could be provided and at any suitable angular orientation relative to one another. The assembly 18 can be rotated 360° and locked in place every 90°. This feature, in addition to allowing left hand and right hand reconfiguration as seen in comparing FIGS. 5A and 5B, can also allow the hoses 27 to be orientated on the left side or right side of the tool 10.

As noted above, the user can also reorientate the lever 52 180° without moving the cap 48 or handle 50. The user can remove the pin 58 from the holes 59, reorientate the lever 52 in the groove 56, and then insert the pin 58 into the holes 60 to pivotably mount the lever 52 at the holes 60. However, repositional mounting of the lever 52 on the handle 50 need not be provided.

Figures 5C, 5D:
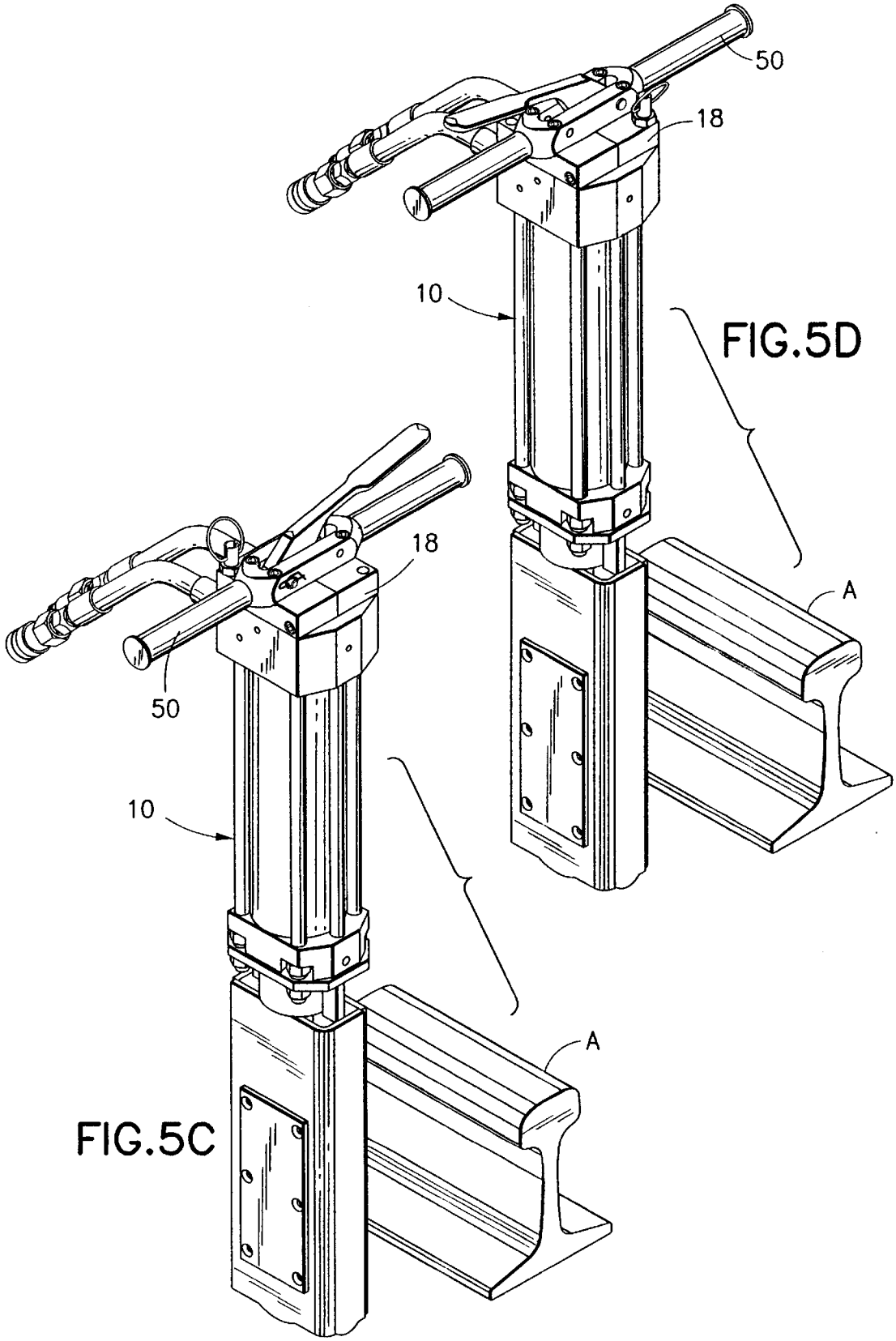
FIG. 5C is a perspective view as in FIG. 5A with the handle in a straddle position relative to the rail.
FIG. 5D is a perspective view as in FIG. 5C with the control lever orientated in a reverse position.

Referring also to FIG. 5C, the same tool 10 is shown. However, the assembly 18 has been repositioned into a straddle configuration with the handle 50 offset 90° from the positions shown in FIGS. 5A and 5B. The handle 50 extends over the rail A and the user straddles the rail A with his feet; one foot on each opposite side of the rail A. FIG. 5C shows the assembly 18 at a position for a right hand user. FIG. 5D shows the same tool 10, but the assembly 18 has been repositioned 180° for use by a left handed user. Thus, a single tool can be reconfigured into both a parallel use configuration or a straddle use configuration relatively easily and simply by the user. A user does not need to disconnect the section 20 from the bottom member 30 in order to reconfigure the tool between parallel and straddle use configurations. The lever 52 is able to actuate the valve member 34 at any position of the assembly 18 relative to the manifold member 26 because the valve member 34 is centrally located, because the valve contact area 62 is centrally located, and because the assembly 18 is rotatably mounted on the same axis that intersects the valve member 34 and contact area 62. In an alternate embodiment the lever 52 could be mounted to the cap 48 rather than the handle 50, or any suitable control could be provided connected to any suitable area on the tool.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. In a hydraulic spike puller having a frame, a hydraulic drive section connected to the frame, and a spike contacting section connected to the hydraulic drive section, wherein the improvement comprises:

a handle repositionably connected to the frame wherein the handle is positionable in a straddle position and a parallel position relative to a railroad rail to pull a spike.

2. A spike puller as in claim 1 wherein the handle is rotatable relative to the frame.

3. A spike puller as in claim 2 wherein the handle intersects a longitudinal axis of the frame and is rotatable about the axis.

4. A spike puller as in claim 2 wherein the handle can rotate at least 90° relative to the frame.

5. A spike puller as in claim 4 wherein the handle can rotate at least 360° relative to the frame.

6. A spike puller as in claim 1 further comprising a user actuated control pivotably connected to the handle.

7. A spike puller as in claim 1 wherein the hydraulic drive section comprises a manifold member having hydraulic conduits therethrough and a valve member connected to the manifold member, wherein the spike puller further comprises a cap rotatably connected to the manifold member.

8. A spike puller as in claim 7 wherein the handle is mounted to the cap and the user actuated control is pivotably connected to the cap.

9. A hydraulic tool manifold and rotatable handle assembly comprising:

a manifold member having hydraulic conduits therethrough;

a valve member movably mounted in one of the conduits of the manifold member;

a cap repositionably connected to the manifold member;

a handle connected to the cap; and a user actuated control movably connected to the handle and adapted to move the valve member relative to the manifold member, wherein the handle and the user actuated control can be repositioned with the cap relative to the manifold member to allow the user actuated control to move the valve member at multiple positions of the handle relative to the manifold member.

10. An assembly as in claim 9 wherein the valve member is centrally located in one of the conduits.

11. An assembly as in claim 10 wherein the valve member is longitudinally movable in its respective conduit.

12. An assembly as in claim 9 wherein the user actuated control comprises a lever which is pivotably connected to the handle.

13. An assembly as in claim 9 wherein the cap is rotatably connected to the manifold member and the tool further comprises a lock for locking the position of the cap relative to the manifold member.

14. An assembly as in claim 13 wherein the lock comprises a pin movably connected to the cap and extendible into a hole in the manifold member.

15. An assembly as in claim 12 wherein the user actuated control is repositionally connected to the handle in at least two opposite positions.

16. In a hydraulic spike puller having a frame, a hydraulic drive section connected to the frame, and a spike contacting section connected to the hydraulic drive section, wherein the improvement comprises:

a user control assembly comprising a handle section and a lever, wherein the assembly is repositionably mounted to the hydraulic drive section.

17. A spike puller as in claim 16 wherein the lever is pivotably mounted to the handle section in at least two locations.

18. A spike puller as in claim 16 wherein the assembly is repositionable relative to the hydraulic drive section in 90° increments.

19. A spike puller as in claim 16 wherein the assembly is rotatably mounted to a top end of the spike puller and a movable lock is provided to releaseably lock the position of the assembly to the top end.

* * * * *